US006706651B2

(12) United States Patent
Hamajima et al.

(10) Patent No.: US 6,706,651 B2
(45) Date of Patent: Mar. 16, 2004

(54) FLOAT TEXTILE HAVING IMPROVED OPTICAL INTERFERENCE FUNCTION AND USE THEREOF

(75) Inventors: Norimitsu Hamajima, Ibaraki (JP); Hiroshi Goto, Ayase (JP); Manabu Tachibana, Yokohama (JP); Takanori Taguchi, Kyoto (JP); Kazuhiro Masumoto, Kyoto (JP)

(73) Assignees: Teijin Limited, Osaka (JP); Nissan Motor Co., Ltd., Kanagawa (JP)

( * ) Notice: Subject to any disclaimer, the term of this patent is extended or adjusted under 35 U.S.C. 154(b) by 54 days.

(21) Appl. No.: 09/842,197

(22) Filed: Apr. 26, 2001

(65) Prior Publication Data

US 2002/0016117 A1 Feb. 7, 2002

(30) Foreign Application Priority Data

Apr. 27, 2000 (JP) ..... 2000-127846

(51) Int. Cl.[7] ..... D03D 15/00
(52) U.S. Cl. ..... 442/192; 442/203
(58) Field of Search ..... 442/192, 203

(56) References Cited

U.S. PATENT DOCUMENTS 6,430,348 B1 * 8/2002 Asano et al. ..... 385/131

FOREIGN PATENT DOCUMENTS

| | | | |
|---|---|---|---|
| EP | 0 921 217 A1 | 6/1999 | |
| JP | 7-34320 | 2/1995 | ..... D01F/6/00 |
| JP | 7-34324 | 2/1995 | ..... D01F/8/04 |
| JP | 7-331532 | 12/1995 | ..... D01F/8/04 |
| JP | 11-107109 | 4/1999 | ..... D03F/15/00 |
| WO | 98/46815 | 10/1998 | ..... D01F/8/14 |

* cited by examiner

*Primary Examiner*—Elizabeth M. Cole
(74) *Attorney, Agent, or Firm*—Sughrue Mion, PLLC

(57) ABSTRACT

A float textile having an improved optical interference function, containing a float texture yarn formed by combining three or more multi-filament yarns each comprising, as a constituent unit, optically interfering mono-filaments which are formed by alternately laminating layers of at least two polymers having different refractive indices and which have flattening ratio of 4 to 15 and by interlacing the multi-filament yarns to form 20 or less interlaces per meter, used as a warp float and/or weft float component, and having a float number of 2 or more. A spun-dyed textile which is formed by combining a large number of optically interfering multi-filament yarns can provide a float textile which can exhibit a bright color development effect and can expand the utility thereof to room interior and car interior fields.

8 Claims, 2 Drawing Sheets

(a)

(b)

FLOAT TEXTILE HAVING IMPROVED OPTICAL INTERFERENCE FUNCTION AND USE THEREOF

DETAILED DESCRIPTION OF THE INVENTION

1. Field of the Invention

The present invention relates to a float textile having an optical function and, more specifically, to a float textile formed of multi-filament yarn having the optical function of developing color by the reflection, interference, diffraction or scattering of light.

2. Prior Art

In recent years, to meet demand for cloth having a quality feel, a bulked fiber has been developed as a new synthetic fiber by changing the cross sectional form of the fiber from a simple round form to a different form and by combining two or more different fibers. Fibers having higher feeling and more advanced functions are now in demand. One of them is a fiber having a color deepness and gloss. When a color deepness and gloss are to be attained at the same time, a color deepness effect is obtained but the color of the fiber becomes dull and not bright any more. On the other hand, when a gloss is to be attained, a facinated light is not obtained. There has been no technology for attaining the both functions. The reason for this is that the intensity of reflected light decreases as a higher color deepness effect is to be obtained with the result of the disappearance of a gloss because a color is developed by a dye or pigment, that is, a color is developed by the absorption of light in the prior art.

Meanwhile, looking at around the world of nature, for example, *Chrysochroa fulgidissima* and Morpho butterfly have a color deepness and gloss and show a color completely different from a color developed by a dye or pigment. This color development mechanism is due to the reflection and interference of light. Even in synthetic fibers, various measures have been taken to make use of this mechanism. For example, JP-A 7-34320, JP-A 7-34324 and JP-A 7-331532 (the term "JP-A" as used herein means unexamined published Japanese patent application) disclose a optically interfering flat mono-filament having a multi-layer thin film structure formed by laminating polymers having different refractive indices (optical refractive indices) alternately and a flattening ratio of 3.5 or less.

Natural light incident upon this optically interfering mono-filament ideally develops a reflection spectrum based on multi-layer thin film interference, that is, an interference color. In fact, part of natural light transmits, refracts or scatters due to the imperfection of the structure of the mono-filament (such as a difference in thickness between polymer layers and a difference in crystallinity between used polymers), dependence upon wavelength of refractive index (polymer dispersibility) and dependence upon wavelength of absorption coefficient and functions as so-called "stray light". This means that a reflection component based on the above stray light is superimposed upon the reflection spectrum based on the multi-layer thin film interference, thereby impairing the original bright color. Therefore, the above JP-A 7-331532 proposes a technology for interweaving an optically interferring mono-filament with a black-colored spun-dyed fiber to plain weave, twill weave or satin weave to prevent the above stray light.

Further, although a multi-filament yarn is generally used in the filament textile, when the multi-filament yarn prepared by bundling the above mono-filaments is simply used in combination with a densely color fiber, the effect of removing stray light is obtained but a color based on optical interference which is originally intended is not always expressed. Therefore, JP-A 11-107109 proposes a float textile woven of multi-filaments as a float component formed of optically interfering mono-filaments having a flattening ratio of 4 to 15 as a constituent unit.

However, it has been found that, according to application purpose, particularly room interior and car interior fields, a large number of optically interfering flat mono-filaments to be bundled is necessary in a floating portion of the texture and that the textile of JP-A 11-107109 does not always exhibit a color development effect to the full.

That is, when the above-explained optically interfering mono-filament is supplied for weaving, there are proposed (1) a method in which a sizing agent is applied to yarn in a zero-twisted state and (2) a method in which yarn is twisted. However, in the method (1), the sizing agent adhered to the surface of yarn reduces the color development and a desired color cannot be always obtained. Further, the sizing agent may fall off at the time of weaving, thereby impairing productivity. In the method (2), since the filament is axially twisted, reflected light which is color developing light is scattered and weakened with the result that the color development effect of the filament cannot be exhibited to the full.

SUMMARY OF THE INVENTION

It is an object of the present invention to provide a textile which can exhibit the bright color development effect of an optically interfering flat mono-filament even when a large number of multi-filaments each formed of the above mono-filaments as a constituent unit are bundled.

The inventors of the present invention have found that the reason why the color development effect of yarn as a whole cannot be exhibited to the full when a large number of the above optically interfering flat multi-filaments are bundled is the axial twisting of the flat filament. The present invention has been accomplished based on this finding.

Thus, according to the present invention, there is provided a float textile having an optical interference function, containing a float texture that yarn formed by combining three or more multi-filament yarns each comprising, as a constituent unit, optically interfering mono-filaments which are formed by alternately laminating layers of at least two polymers having different refractive indices and which have a flattening ratio of 4 to 15 and by interlacing the 3 or more multi-filament yarns to form 20 or less interlaces per meter is used as a warp float and/or weft float component, and having a float number of 2 or more.

Figure 1:
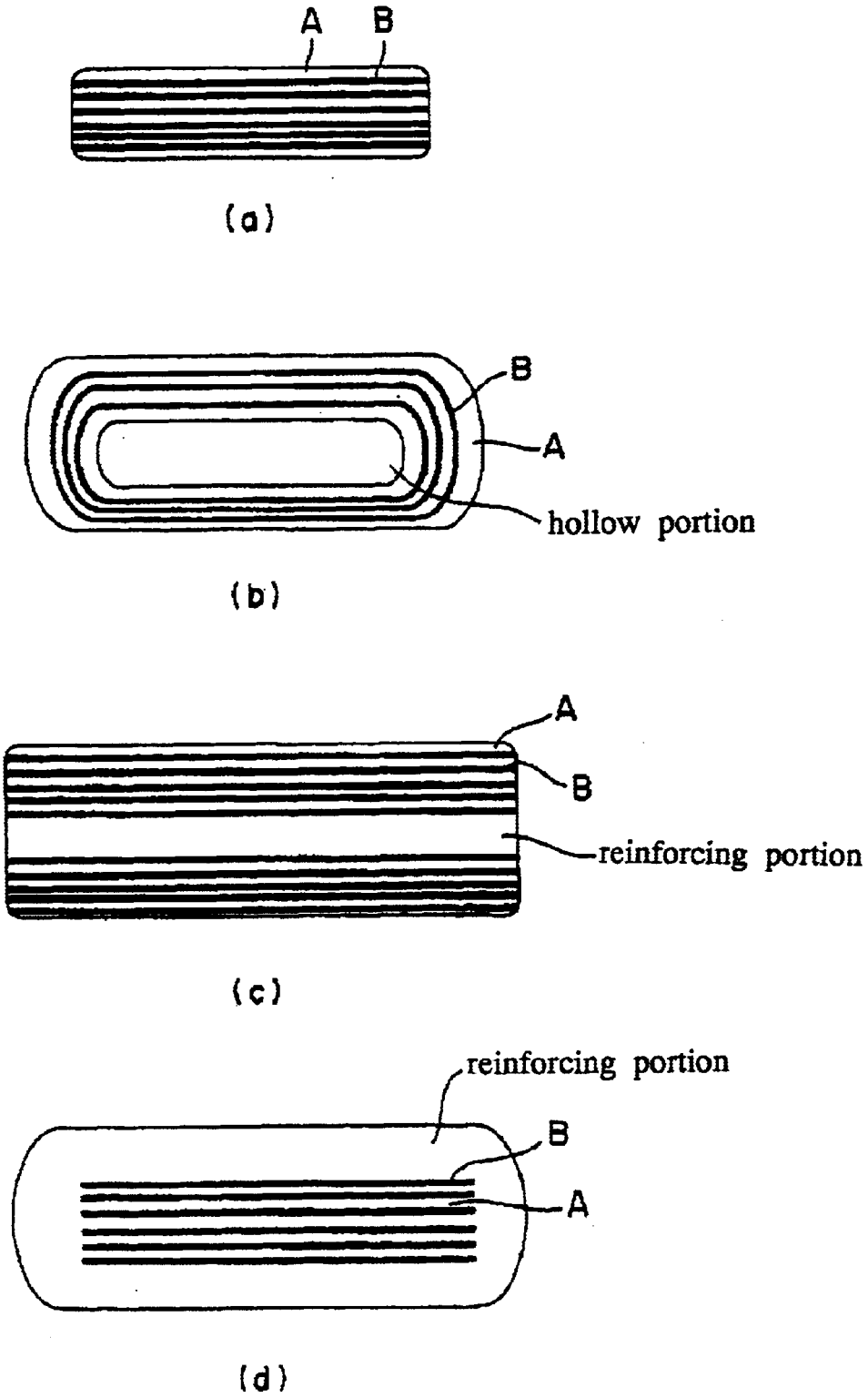
FIG. 1 are schematic sectional views of an optically interfering mono-filament constituting a multi-filament yarn which the present invention is directed to, wherein FIG. 1(*a*) shows the shape of a mono-filament formed by alternately laminating layers of polymers A and B having different refractive indices in the major axis direction of a flat cross section, FIG. 1(*b*) shows the shape of a hollow flat cross section, FIG. 1(*c*) shows the shape of a mono-filament having a reinforcing portion (film) made from the above polymer A or B, or another polymer in the intermediate portion of the alternate laminate, and FIG. 1(*d*) shows the shape of a mono-filament having a reinforcing portion (film) at the periphery.
Figure 2:
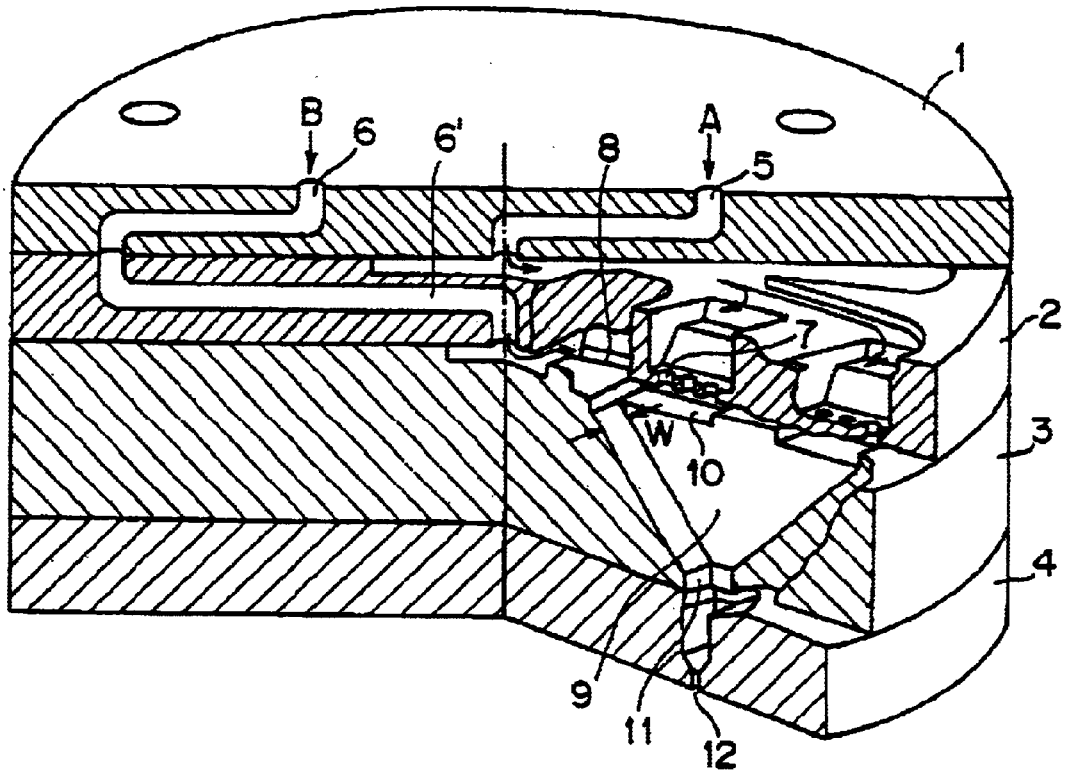
FIG. 2(*a*) is a partly sectional perspective view of a spinneret used to extrude an optically interfering multi-filament yarn used in the present invention, and FIG. 2(*b*) is a partly sectional view of a variation of the spinneret (a).
Figure 2:
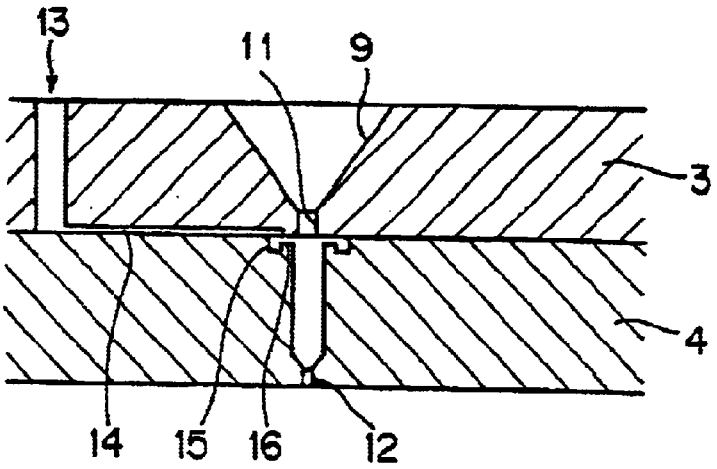

Symbols in FIG. 1 and FIG. 2 denote the following elements.

A polymer layer
B polymer layer having a different refractive index from the polymer layer A
1 upper distributor
2 upper spinneret member
3 center spinneret member
4 lower spinneret member
5 flow path
6 flow path
7 a line of openings
8 radial flow path
9 funnel-shaped portion
10 dam
11 flow path of reinforcing polymer
12 flow path of reinforcing polymer
13 flow path of reinforcing polymer
16 flow path of reinforcing polymer

DETAILED DESCRIPTION OF THE PREFERRED EMBODIMENT

In the present invention, a multi-filament yarn comprising as a constituent unit the above mono-filaments which are formed by alternately laminating layers of at least two polymers having different refractive indices is used as a float component of a textile. In this case, what is important is that a mono-filament having a flattening ratio of 4 to 15 is used and the multi-filament is interlaced to form 20 or less interlaces, preferably 5 to 15 interlaces per meter before weaving so as to exhibit the optical interference effect of the whole multi-filament yarn to the fullest extent.

The above flattening ratio refers to a value of a ratio W/T in which W is the length of the major axis of the flat cross section and T is the length of the minor axis thereof. A flattening ratio of 3.5 is sufficient for attaining the function of optical interference as a mono-filament as is conventionally proposed with regard to the flattening ratio. When a plurality of such mono-filaments are combined and used as a multi-filament yarn, however, flat major-axis surfaces of the mono-filaments are arranged at random and bundled, and a multi-filament yarn as a whole can no longer effectively exhibit the function of optical interference.

However, when the flattening ratio is a value of 4 or more, preferably 4.5 or more, each filament to constitute the multi-filament yarn is imparted with the function of self-direction-dependency control, and the filaments are bundled and formed into a multi-filament yarn such that the flat major axis surfaces of the constituent filaments are in parallel with one another. That is, when the above filaments are pressed and tensioned with a take-up roller or a stretch roller in the step of forming the filaments, when they are taken up around a bobbin in the form of cheese, or when the yarn is pressed on a yarn guide, etc., in the step of weaving a fabric, the parallelism of flat major axis surfaces of the constituent filaments increases, and the fabric comes to show a superior optical interference function.

Concerning the upper limit of the flattening ratio, when the value thereof exceeds 15.0, an extremely flat form is produced so that it is difficult to maintain the flat cross section, and there is possibility of partly bending in the cross section. In view of the above point, the flattening ratio for easy handling is 15.0 at the most, and it is particularly preferably 10.0 or less.

As described above, the flattening ratio of the constituent filaments is increased to be as large as 4.0 to 15.0 as compared with those of conventional optically interfering filaments, and therefore, the number of the alternately laminated layers is preferably increased as compared with the number of conventional laminated layers. That is, the number of the laminated layers is preferably at least 15, more preferably at least 20, particularly preferably at least 25.

According to the optical interference theory, if the thicknesses of all the layers equal the standard thickness, an obtained interference light quantity reaches saturation state when the number of the laminated layers is 10 at the most. However, since the thickness of each layer undergoes fluctuation inevitably in the step of forming yarn, when the number of the laminated layer is 10, the optical interference effect becomes deficient. From this sense, the above defect is compensated for when the number of laminated layers is 15 or more, preferably 20 or more. The upper limit of the number of laminated layers is 120, particularly 70 in consideration of the complicated structure of a spinneret and the control of molten polymer flows.

Further, the optically interfering multi-filament of the present invention has an elongation in the range of 10 to 60%, preferably 20 to 40%. That is because the multi-filament which has been spun and once cooled to solidification is drawn to increase its birefringence ($\Delta n$), so that the refractive index difference as "refractive index of polymer plus birefringence of fiber" between polymers is consequently increased as a whole, whereby the function of optical interference is increased.

In the present invention, a float texture having a float number of 2 or more and constructed by a multi-filament yarn as a warp float and/or weft float component which is formed of the above mono-filaments as a constituent unit is formed in the whole or part of a textile. The above textile of the float texture includes satin, Jacquard, dobby, twill and dice pattern. Out of these, dobby and Jacguard are preferred.

When a number of optically interfering multi-filament yarns are allowed to be present on the surface of a textile, the float ratio (area ratio) of the optically interfering multi-filament yarns in one entire texture (one repeat) of the textile is 20 to 95%, preferably 70% to 90%. When the float ratio exceeds 60%, the color development produced by optical interference is clearly shown. On the other hand, when it exceeds 95%, undesirably, the crossing frequency of the fibers constituting the textile is extremely low so that the fibers are easily loosened and the strength and the form of the textile can be no longer maintained. When the float ratio is 90% or less, desirably, not only the crossing of the fibers can be fully maintained, but also a large number of fibers having the optical-interference function can be arranged on the textile surface.

The float number of the float texture will be explained below. The float number when the fiber is used as a warp refers to how many wefts the warp passes over to cross with a weft, "the number of wefts over which the warp passes". For example, the float number of the warps is 1 in a 1/1 plain weave fabric, 2 in a 2/2 twill, 3 in a 3/2 twill, or 4 in a 4/1 satin. Further, the float number of the wefts is 3 in a 2/3 twill or 4 in a 1/4 satin texture.

The color development and the optical interference effect (i.e., development of a sharp color having an intense gloss and a color deepness) of a texture using the fiber having the optical-interference function as a warp or a weft will be explained mainly on the basis of the above woven textures. When the float number in a woven texture is less than 2, a different color effect is observable only on the basis of a difference from the color of other fiber, while it is only as efficient as that of a chambray fabric. When the float ratio exceeds 60% and the float number is 2 or more, the optical interference effect can be obtained. And, when the float number exceeds 4, the optical interference effect is further increased. The upper limit of the float number is 15 at the most. When it exceeds 15, the crossing frequency of the fibers constituting the textile is extremely low so that the fibers of the textile easily undergo "loosening" and the strength and the form of the textile can be no longer maintained. When the float number is 10 or less in particular, the strength, the form stability and the high optical interference effect of the textile can be attained.

The above-described optically interfering multi-filament yarn is used for weaving in an interlaced state. The number of interlaces is 50/m or less, preferably 20/m or less.

When the multi-filament yarn is used for weaving, it is the most popular to employ a twisting technique to give bundle formability to yarn. In the case of the optically interfering multi-filament, axial twisting occurs, scattering reflected light and reducing the optical interference effect.

However, according to the interlacing technique, the optically interfering multi-filament yarn can be present in a portion other than the interlaced portion (portion where the multi-filament yarn is entangled) without impairing the parallelism of the flat major axis surfaces of the constituent filaments and a high optical interference effect can be obtained. When the number of interlaces exceeds 50 per meter, the parallelism of the flat major axis surfaces of the constituent filaments decreases in a portion other than the interlaced portion (more axial twists) with the result of a reduction in the optical interference effect.

Interlacing is carried out under general conditions. That is, the compressed air pressure is 1.5 to 3 $kg/m^2$, the overfeed rate is 0.5 to 2%, and the processing speed is 200 to 600 m/min.

Further, when the strength of the textile is needed, 3 or more yarns are combined and interlaced. However, when the number of yarns to be combined is too large, the color development effect decreases. This is because the proportion of fibers having the function of absorbing stray light decreases and the function of absorbing stray light does not work as the optically interfering filament yarn is thick.

Therefore, the number of the optically interfering multi-filament yarns is preferably 6 at the most.

A plurality of wefts are often inserted per opening in warp to provide a change in the design pattern of a textile. When the optically interfering multi-filament yarn is used, the number of inserted wefts is 144 or less, preferably 36 or less in the terms of mono-filaments to obtain a color development effect.

According to another embodiment of the present invention, a densely colored fiber, preferably a fiber having an L value of 20 or less is preferably used as a fiber constituting a textile other than the float component to remove stray light in the above float textile. Thereby, a color development effect can be fully maintained by using mono-filaments having a flattening ratio of 4 or more as the constituent unit of the multi-filament yarn.

The above point will be explained. The optically interfering filament forms a color on the basis of the interference of incident light and reflected light. Meanwhile, human eyes recognize the intensity of a color on the basis of a difference between interference light and stray light which is reflected from other site into the eyes. When stray light from around is intense, interference light cannot be recognized as a color even if the interference light is sufficient. As a means of preventing the stray light, it is preferred to use a fiber having the function of absorbing light from around, particularly stray light, as a weft or a warp which is the closest to the optically interfering filament and intertwined with the optically interfering filament. For absorbing stray light, it is preferred to use a fiber dyed in a dense color and/or a spun-dyed fiber. Black is particularly preferred since it absorbs all of rays and has a great effect on the removal of stray light. It is further preferred to use a densely colored fiber having a hue having a complementary color relationship with the formed color of the optically interfering filament as a weft or warp which is intertwined with the optically interfering filament. The fiber colored in a hue having a complementary color relationship with interference light not only absorbs light of the complementary color but also reflects light having a wavelength around that of the interference light. That is, a textile of the above texture has advantages in that it can use interference light and a portion of stray light which has a wavelength around that of the interference light, as reflected light, so that the intensity of the reflected light is further increased, and that a difference from stray light from other portion can be produced to a great extent.

A description is subsequently given of a method for producing the optically interfering multi-filament yarn used in the present invention. As for a combination of polymers, the polymers may be suitably selected from the group consisting of polyesters (such as polyethylene terephthalate and polyethylene naphthalate), polycarbonates, polystyrene, polyolefins, polymethacrylates, polyamides (such as aliphatic polyamides and aromatic polyamides) and the like according to desired refractive indices. Out of these, the following combinations are particularly preferred to secure compatibility (adhesion) between layers:

(a) a combination of a polyester (high refractive index polymer) essentially composed of polyethylene naphthalate which contains a dibasic acid component having a sulfonic acid metal base in an amount of 0.3 to 5 mol % based on the total of all dibasic acid components forming the polyester and an aliphatic polyamide (low refractive index polymer).

(b) a combination of a polyester (high refractive index polymer) essentially composed of polyethylene terephthalate which contains a dibasic acid component having a sulfonic acid metal base in an amount of 0.3 to 10 mol % based on the total of all dibasic acid components and polymethyl methacrylate having an acid value of 3 or more.

(c) a combination of an aromatic copolyester (high refractive index polymer) which contains a dibasic acid component having at least one alkyl group (such as methyl group) in the side chain and/or a glycol component as a comonomer(s) (such as neopentylene glycol, bisphenol A or alkylene oxide adduct thereof) in an amount of 5 to 30 mol % based on the total of all the recurring units and polymethyl methacrylate (low refractive index component).

The above two different polymers are extruded from a spinneret shown in FIG. 2-(*a*) in a molten state. FIG. 2-(*a*) is a partially cutaway perspective view of an example of the spinneret used in the present invention. In the figure, reference numeral 1 denotes an upper distributor, 2 an upper spinneret member, 3 a central spinneret member, and 4 a lower spinneret member. These four disk-like parts are built up together and flow paths 5 and 6 are formed in the upper distributor 1 to feed the polymers A and B separately. A flow path for guiding the polymer A to a line of openings 7 and a flow path 6' for guiding the polymer B to the center of the spinneret are formed in the upper spinneret member 2. The polymer B which has been guided to the center of the center spinneret member 3 passes through a flow path 8 disposed radially in the top surface of the center spinneret member 3 and flows over the top surface of a dam-like portion 10 which communicates with a funnel-shaped portion 9 formed parallel to the flow path 8 in the form of a belt. The polymer A from the line of opening portions 7 flows upon the polymer B passing over the top surface of the dam-like portion 10 in the form of a belt and the polymers A and B alternately laminated in a layer form flow into the funnel-shaped portion 9 (see the arrows in FIG. 2). In the funnel-shaped portion 9, the cross sectional form of the flow path expands in a direction perpendicular to the lamination direction of the polymers so that the laminated polymers are gradually made smaller in size and discharged from an extrusion opening 11 after passing through this funnel-shaped portion 9. Further, a flow of the polymer laminate coming from the extrusion opening 11 passes through the final spinning outlet 12 formed in the lower spinneret member 4 to be spun.

FIG. 2-(*b*) is a sectional view of a variation of the spinneret for forming a reinforcing layer (protective layer) shown in FIG. 1. A polymer flow path 13 for forming the reinforcing layer is formed in the vicinity of the funnel-shaped portion 9 of the center spinneret member 3 of the spinneret shown in FIG. 2-(*a*) to cause the polymer to pass through an annular polymer pool 15 and an annular flow path 16 surrounding the top portion of the spinning outlet 12 through a space between the center spinneret member 3 and the lower spinneret member 4 and to join a flow of the above polymers.

The above method for producing the optically interfering multi-filament yarn is also disclosed by WO 98/46815. The extruded alternate laminate may be wound and thermally stretched (separate stretching method), directly stretched and wound after extrusion, or wound as multi-filament yarn equivalent to stretched yarn making use of high-speed spinning. Out of these, the separate stretching method is the most effective in expanding birefringence between the laminated polymers.

In the finally obtained mono-filament having an alternate laminate structure, the thickness of each polymer layer is preferably 0.02 to 0.3 $\mu$m and the thickness of the reinforcing portion is preferably 2 $\mu$m or more. When the thickness of the reinforcing portion is smaller than 2 $\mu$m, the reinforcing layer and further the formed multiple layers may be peeled off by friction which occurs during actual use. When the thickness of the reinforcing portion is larger than 10 $\mu$m, the absorption and irregular reflection of light in the reinforcing portion cannot be ignored disadvantageously.

The size (dtex) of the mono-filament and the size (dtex) of the multi-filament yarn may be suitably set in consideration of a feel and performance of a desired textile. Generally speaking, the size of the former is selected from a range of 2.2 to 33 dtex (2 to 30 denier) and the size of the latter is selected from a range of 55 to 330 dtex (50 to 300 denier).

The float textile of the present invention has a bright color development effect and is suitably used as a room interior material or car interior material making use of its developed color.

EXAMPLES

The following examples are given to further illustrate the present invention.

Examples 1 to 5 and Comparative Examples 1 to 5

Polyethylene naphthalate having 10 mol % of terephthalic acid and 1 mol % of sodium sulfoisophthalate copolymerized (intrinsic viscosity=0.55 to 0.59, naphthalenedicarboxylic acid=89 mol %) and nylon 6 (intrinsic viscosity=1.3) were used in a volume ratio (composite-forming ratio) of 2/3 and co-spun through a spinneret shown in FIG. 2, and an undrawn yarn whose alternate laminate portion as shown in FIG. 1(*d*) had 30 layers was taken up at a take-up rate of 1,500 m/minute. This as-spun yarn was drawn to 2.0 times with a roller-type drawing machine equipped with a feed roller heated at 110° C. and a drawing roller heated at 170° C., to give a drawn yarn of 90 denier/12 filaments. Layers of two polymers in the center of the flat yarn were measured for a thickness and it was found that the polyethylene naphthalate layer had a thickness of 0.07 $\mu$m and that the nylon layer had a thickness of 0.08 $\mu$m. An interference color of green was recognized. Further, the mono-filaments had a flattening ratio of 5.6.

The thus-obtained fibers having an optical interference effect were interlaced. The processing conditions included a compressed air pressure of 2.5 kg/m$^2$, an overfeed rate of 0.75% and a processing speed of 250 m/min. Further, various textiles of a dobby texture having a weft float number of 3 were formed using yarn obtained by dying black a polyethylene terephthalate fiber as warp and a number shown in Table 1 of the optically interfering multi-filament yarns interlaced to form a number of interlaces shown in Table 1 or yarn twisted 150 times/m as weft. The results are shown in Table 1.

TABLE 1

| | warp | weft | number of optically interfering fibers to be combined | method of combining optically interfering fibers (number of interlaces or number of twists) |
|---|---|---|---|---|
| C. Ex. 1 | black dyed yarn of 330 dtex | optically interfering yarn of 120 dtex | 1 | — |
| C. Ex. 2 | black dyed yarn of 330 dtex | optically interfering yarn of 240 dtex | 2 | interlace (15) |
| C. Ex. 3 | black dyed yarn of 330 dtex | optically interfering yarn of 360 dtex | 3 | interlace (30) |
| Ex. 1 | black dyed yarn of 330 dtex | optically interfering yarn of 360 dtex | 3 | interlace (15) |
| Ex. 2 | mild dyed yarn of 330 dtex | optically interfering yarn of 360 dtex | 3 | interlace (15) |
| Ex. 3 | black dyed yarn of 330 dtex | optically interfering yarn of 360 dtex | 3 | interlace (15) |
| C. Ex. 4 | black dyed yarn of 330 dtex | optically interfering yarn of 360 dtex | 3 | twisted yarn (150) |
| Ex. 4 | black dyed yarn of 330 dtex | optically interfering yarn of 440 dtex | 4 | interlace (15) |
| C. Ex. 5 | black dyed yarn of 330 dtex | optically interfering yarn of 440 dtex | 4 | twisted yarn (150) |

TABLE 1-continued

| Ex. 5 | black dyed yarn of 330 dtex | optically interfering yarn of 550 dtex | 5 | interlace (15) |
|---|---|---|---|---|
| | number of optically interfering fiber mono-filaments per opening in warp | | optical interference effect | strength |
| C. Ex. 1 | 24 | | sufficient gloss, color change, strong color development | X |
| C. Ex. 2 | 24 | | sufficient gloss, color change, considerable color development | X |
| C. Ex. 3 | 36 | | slight gloss, color change, slight color development | ○ |
| Ex. 1 | 36 | | sufficient gloss, color change, sufficient color development | ○ |
| Ex. 2 | 36 | | gloss, slight color change, slight color development | ○ |
| Ex. 3 | 144 | | sufficient gloss, color change, color development | ○ |
| C. Ex. 4 | 144 | | slight gloss, color change, slight color development | ○ |
| Ex. 4 | 192 | | gloss, color change, color development | ○ |
| C. Ex. 5 | 192 | | slight gloss, color change, slight color development | ○ |
| Ex. 5 | 240 | | gloss, slight color change, slight color development | ○ |

Ex.: Example
C. Ex.: Comparative Example

When the float textile obtained in Example 1 was evaluated as a car interior material and chair sheet material, it exhibited an excellent color development effect and its color changed by view angle according to the undulation of the sheet. Thus, the float textile was excellent in design.

EXAMPLE 6

A textile of a Jacguard texture having a weft float number of 3 was formed using the same yarn as in Example 1 as warp and weft. The obtained textile had a sufficient gloss and color change and developed a color to the full as in Example 1.

EFFECT OF THE PRESENT INVENTION

Since even a thick textile which is formed by combining a large number of optically interfering multi-filament yarns can exhibit a color development superior effect, it can expand the utility thereof to room interior material and car interior material fields.

What is claimed is:

1. A float textile having an improved optical interference function, containing a float texture wherein interlaced yarn formed by combining three or more multi-filament yarns each comprising, as a constituent unit, optically interfering mono-filaments which are formed by alternately laminating layers of at least two polymers having different refractive indices and which have a flattening ratio of 4 to 15 and by interlacing the combined multi-filament yarns to form 20 or less interlaces per meter is used as a warp float and/or weft float component, and having a float number of 2 or more.

2. The float textile having an improved optical interference function of claim 1, wherein the float texture is dobby.

3. The float textile having an improved optical interference function of claim 1, wherein the float texture is Jacguard.

4. The float textile having an improved optical interference function of claim 1, wherein the float ratio of the optically interfering multi-filament yarns in one repeat of the textile is in the range of 20 to 95%.

5. The float textile having an improved optical interference function of claim 1, wherein fibers constituting a portion other than the float texture are color dyed or spun-dyed fibers having an L value of 20 or less.

6. The float textile having an improved optical interference function of claim 1, wherein the number of optically interfering mono-filaments inserted as weft per opening in warp in a float portion is 144 or less.

7. A car interior material which is the float textile of claim 1.

8. A room interior material which is the float textile of claim 1.

* * * * *